US005400916A

United States Patent [19]

Weber

[11] Patent Number: 5,400,916

[45] Date of Patent: Mar. 28, 1995

[54] PAINT ROLLER BUCKET

[76] Inventor: Daniel C. Weber, 78-02 Cloverdale Blvd., Bayside, N.Y. 11364

[21] Appl. No.: 203,389

[22] Filed: Mar. 1, 1994

[51] Int. Cl.[6] ..... B65D 90/04

[52] U.S. Cl. ..... 220/404; 220/410; 220/570; 220/675; 220/697; 220/769; 220/770; 206/229; 222/572; 15/257.05; 15/257.06

[58] Field of Search ..... 220/570, 404, 405, 406, 220/410, 608, 669, 670, 671, 675, 697, 760, 769, 770, 773; 206/229; 15/257.05, 257.06; 222/572

[56] References Cited

U.S. PATENT DOCUMENTS

| | | | |
|---|---|---|---|
| 3,292,815 | 12/1966 | Smith et al. | 15/257.05 X |
| 3,419,196 | 12/1968 | Moore | 220/770 X |
| 3,514,012 | 5/1970 | Martin | 220/404 |
| 3,707,242 | 12/1972 | Golden et al. | 220/570 |
| 3,757,990 | 9/1973 | Buth | 220/404 |
| 3,837,034 | 9/1974 | Leffert et al. | 220/570 X |
| 4,122,973 | 10/1978 | Ahern | 220/404 |
| 4,205,411 | 6/1980 | Cupp et al. | 15/257.06 |
| 5,064,058 | 11/1991 | Hirzel | 206/229 X |
| 5,236,340 | 8/1993 | Hall et al. | 220/606 |
| 5,314,061 | 5/1994 | Bedrossian | 206/229 |

*Primary Examiner*—Allan N. Shoap
*Assistant Examiner*—Stephen Cronin
*Attorney, Agent, or Firm*—Michael I. Kroll

[57] ABSTRACT

A paint roller bucket is provided, which consists of a receptacle having an open top with a deep well to hold a large amount of paint, so that a paint roller can be inserted into the paint. A component is for carrying the receptacle from place to place making it portable.

1 Claim, 2 Drawing Sheets

PAINT ROLLER BUCKET

BACKGROUND OF THE INVENTION

1. Field of the Invention

The instant invention relates generally to painting tools and more specifically it relates to a paint roller bucket.

2. Description of the Prior Art

Numerous painting tools have been provided in prior art that are adapted to assist people to paint walls, ceilings and floors in buildings and the like. While these units may be suitable for the particular purpose to which they address, they would not be as suitable for the purposes of the present invention as heretofore described.

SUMMARY OF THE INVENTION

A primary object of the present invention is to provide a paint roller bucket that will overcome the shortcomings of the prior art devices.

Another object is to provide a paint roller bucket that can hold three times the amount of paint than the standard paint roller tray and also has a sloping well to prevent paint from spilling over the sides when being used with a paint roller.

An additional object is to provide a paint roller bucket that includes a built in pouring spout to return the paint back into the paint can and a throwaway liner, which will keep the bucket clean after being used.

A further object is to provide a paint roller bucket that is simple and easy to use.

A still further object is to provide a paint roller bucket that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
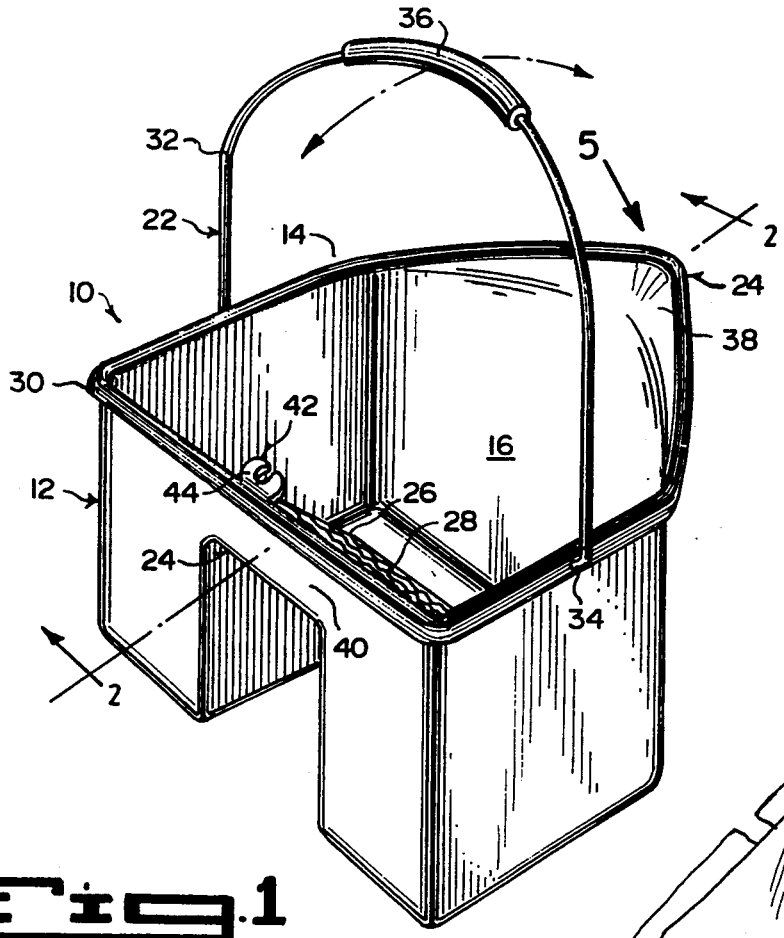
FIG. 1 is a rear perspective view of the instant invention.
Figure 2:
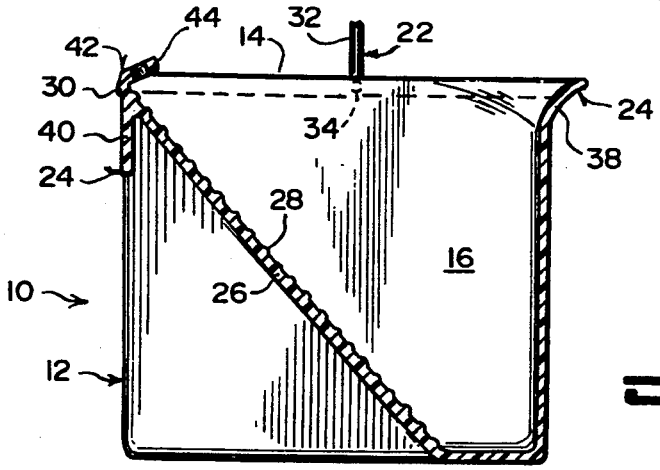
FIG. 2 is a cross sectional view taken along line 2—2 in FIG. 1.

Turning now descriptively to the drawings, in which similar reference characters denote similar elements throughout the several views, FIGS. 1, 2, 4 and 5 illustrate a paint roller bucket 10, which consists of a receptacle 12 having an open top with a deep wall 16 to hold a large amount of paint 18, so that a paint roller 20 can be inserted into the paint 18. A component 22 is for carrying the receptacle 12 from place to place making it portable.

The receptacle 12 contains a structure 24 for returning paint 18 not used back into a paint can for storage. The deep well 16 of the receptacle 12 includes an inwardly angled wall 26 to allow the paint roller 20 to roll on. The inwardly angled wall 26 includes a rippled surface 28 to help apply the paint 18 onto the paint roller 20, when the paint roller 20 rolls upon the rippled surface 28 on the inwardly angled wall 26.

The receptacle 12 contains a lip 30 extending about the open top 14 above the deep wall 16. The carrying component 22 includes a wire handle 32, having two ends swiveled in the lip 30 on opposite sides of the open top 14 of the receptacle 12. A handle grip 36 is on the wire handle 32 to be engaged by a hand of a person, so as to lift the receptacle 12 by the handle grip 36.

The paint returning structure 24 consists of a pouring spout 38 formed at a forward end of the lip 30 of the open top 14 of the receptacle 12. A recessed pouring hand grip 40 is formed in a rearward end below the lip 30 of the open top 14 of the receptacle 12 under an upper edge of the inwardly angled wall 26 opposite from the pouring spout 38.

An element 42 is for retaining in a stationary position the paint roller 20 against the rippled surface 28 on the inwardly angled wall 26. The retaining element 42 is a C-shaped clamp holder 44 formed on the lip at the upper edge of the inwardly angled wall, in which the clamp holder 44 will engage with a shaft of the paint roller.

Figure 3:
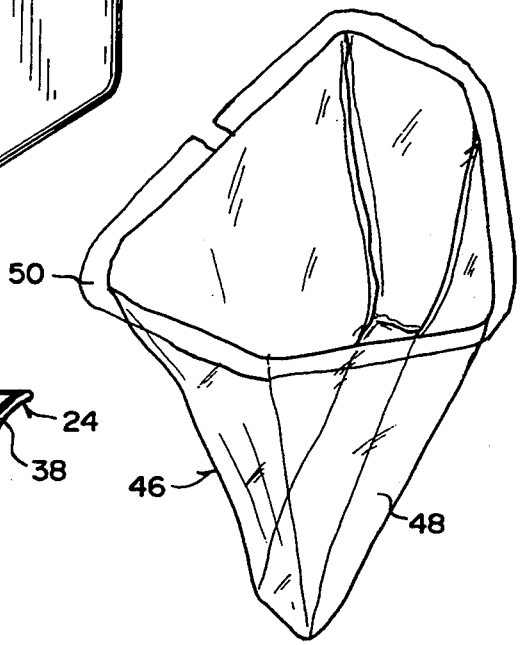
FIG. 3 is a front perspective view of the throwaway liner.
Figure 4:
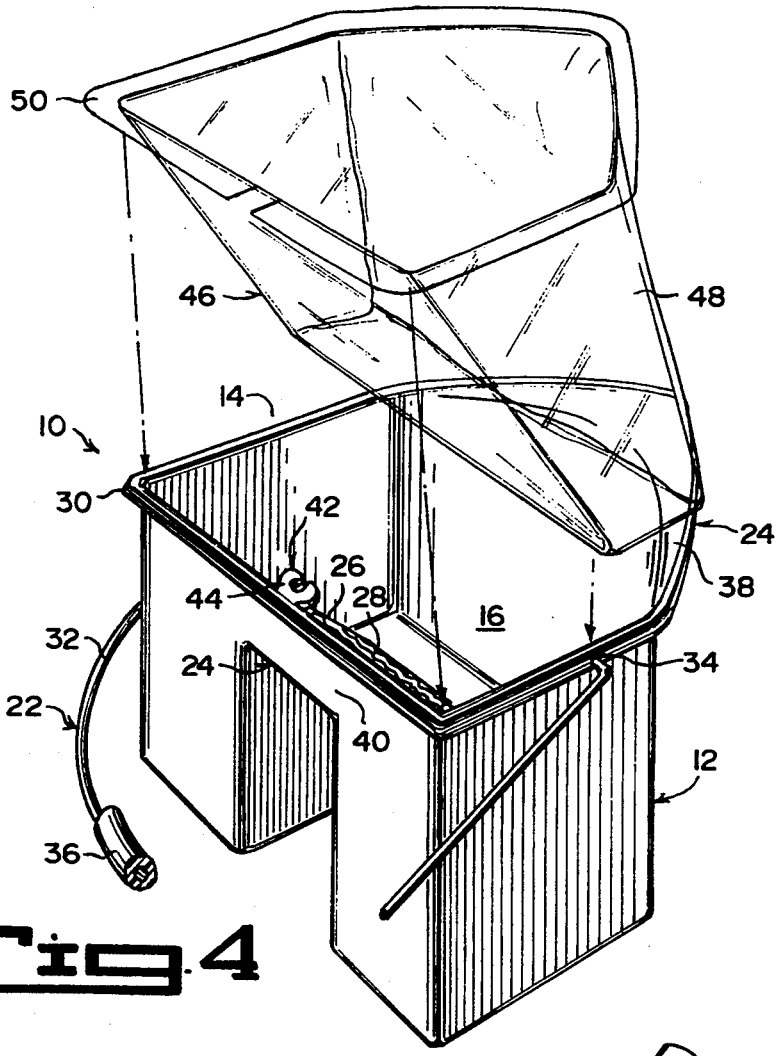
FIG. 4 is a rear perspective view similar to FIG. 1, showing the throwaway liner ready to be inserted within the bucket.
Figure 5:
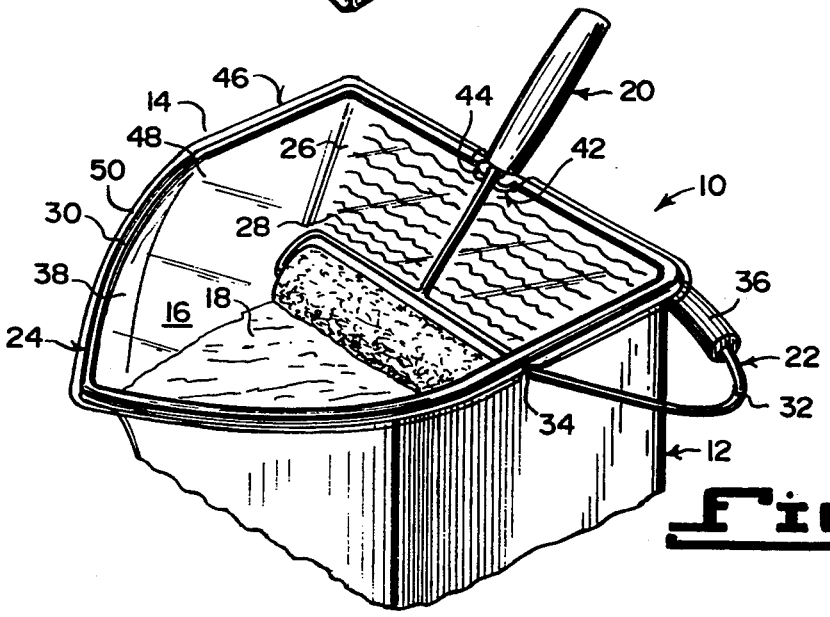
FIG. 5 is a front perspective view with parts broken away taken in the direction of arrow 5 in FIG. 1, with the throwaway liner installed in place and the paint roller retained therein.

A member 46, as shown in FIGS. 3, 4 and 5, is insertable within the deep well 16 of the receptacle 12, for covering the rippled surface 28 on the inwardly angled wall 26, so as to keep the deep well 16 paint free. The covering member 46 is a throwaway light plastic liner 48, having an upper flange 50 thereabout and is shaped to fit into the deep well 16 with the upper flange 50 extending over the lip 30 of the receptacle 12.

OPERATION OF THE INVENTION

To use the paint roller bucket 10, the following steps should be taken:

1. Hold the hand grip 36 by the hand.
2. Lift the receptacle 12 and carry it to a location where painting is to be done.
3. Place the receptacle 12 upon a flat surface.
4. Insert the plastic liner 48 into the deep well 16.
5. Fold the upper flange 50 over the lip 30 on the receptacle 12.
6. Pour the paint 18 into the plastic liner 48.
7. Roll the paint roller 20 on the portion of the plastic liner 48 that rests upon the rippled surface 28 on the inwardly angled wall 26, so that the paint roller 20 will receive some of the paint 18.
8. Remove the plastic liner 48 from the deep well 16 after completing the painting, so that the deep well 16 will be paint free.

| LIST OF REFERENCE NUMBERS | |
|---|---|
| 10 | paint roller bucket |
| 12 | receptacle |
| 14 | open top on 12 |
| 16 | deep well in 12 |
| 18 | paint |
| 20 | paint roller |

-continued

| LIST OF REFERENCE NUMBERS | |
|---|---|
| 22 | carrying component |
| 24 | paint returning structure |
| 26 | inwardly angled wall in 16 |
| 28 | rippled surface on 26 |
| 30 | lip on 12 |
| 32 | wire handle |
| 34 | swivel end of 32 |
| 36 | hand grip on 34 |
| 38 | pouring spout |
| 40 | recessed pouring hand grip |
| 42 | retaining element |
| 44 | C-shaped clamp holder for 42 |
| 46 | covering member |
| 48 | throwaway light plastic liner for 46 |
| 50 | upper flange on 48 |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A paint roller bucket which comprises:

a) a receptacle having an open top with a deep well to hold a large amount of paint, so that a paint roller can be inserted into the paint, said receptacle having a lip extending about the open top above said deep well, and having an inwardly angled wall to allow the paint roller to roll on, said angled wall having a rippled surface to help apply the paint onto said roller when the roller rolls upon said rippled surface and having a pouring spout opposite said angled wall;

b) means for carrying said receptacle from place to place making it portable, said carrying means having a wire handle with two ends swiveled in said lip on opposite sides of said open top of said receptacle, and a handle grip on said wire handle to be engaged by a hand of a person, so as to lift said receptacle by said handle grip;

c) means for retaining in a stationary position the paint roller against said rippled surface comprising a C-shaped clamp holder formed on said lip at the upper edge of said inwardly angled wall to engage with a shaft of the paint roller;

d) means comprising a light throwaway insert for said receptacle for returning paint not used back into a paint can for storage, said insert including a pouring spout corresponding to said pouring spout of said receptacle when inserted into said receptacle, and said receptacle having a recessed pouring hand grip formed in a rearward end of said receptacle below said lip of said open top under an upper edge of said inwardly angled wall opposite from said pouring spout, said insert covering said rippled surface so as to keep said deep well paint free.

* * * * *